US005570493A

United States Patent [19]

Gulick

[11] Patent Number: 5,570,493

[45] Date of Patent: Nov. 5, 1996

[54] CAP BRACE AND BRACKET

[75] Inventor: Kenneth J. Gulick, Cincinnati, Ohio

[73] Assignee: Batesville Casket Company, Inc., Batesville, Ind.

[21] Appl. No.: 342,352

[22] Filed: Nov. 18, 1994

[51] Int. Cl.[6] ..... A61G 17/00

[52] U.S. Cl. ..... 27/18; 27/14; 16/357; 292/338

[58] Field of Search ..... 27/14, 18; 292/328, 292/268, DIG. 19; 217/60 B, 60 C; 220/335; 16/357, 358, 362, 371

[56] References Cited

U.S. PATENT DOCUMENTS

| | | | |
|---|---|---|---|
| 1,056,996 | 3/1913 | Isaacson et al. | 217/60 B |
| 1,096,964 | 5/1914 | Temple | 217/60 C |
| 1,303,441 | 5/1919 | Wilton | 217/60 C |
| 1,335,626 | 3/1920 | Villinger | 217/60 C |
| 1,796,551 | 3/1931 | Wismer | 217/606 X |
| 3,060,546 | 10/1962 | Nelson | 27/18 |
| 3,959,859 | 6/1976 | Stein, Jr. et al. . | |
| 4,089,084 | 5/1978 | Droz | 16/357 |
| 4,173,092 | 11/1979 | Nakai | 292/338 X |
| 4,524,496 | 6/1985 | Tehsildar | 27/18 |
| 4,925,223 | 5/1990 | Craft . | |

*Primary Examiner*—Carl D. Friedman
*Assistant Examiner*—Beth A. Aubrey
*Attorney, Agent, or Firm*—Wood, Herron & Evans

[57] ABSTRACT

A casket cap brace support comprises a support bracket adapted to be affixed to a wall of the casket body and including an aperture therethrough adapted to receive an end of a brace member, an elongated brace member having one end pivoted to the cap and the other end received in the support bracket aperture, the other end having a projection thereon, the support bracket having an elongated slot therein with a terminal end, the brace member projection being received in the slot during at least a portion of the movement of the cap to and between the closed and open positions, the slot being so configured such that when the cap is in the open position the brace member is in compression, the brace member projection residing in the slot terminal end and being prevented from moving out of the slot terminal end by the action of the weight of the cap, the cap thereby being resistant to inadvertent closing in the event that the casket cap or body is accidentally bumped. In another form, the slot is routed directly into the casket wall and receives the brace member projection.

17 Claims, 3 Drawing Sheets

CAP BRACE AND BRACKET

FIELD OF THE INVENTION

This invention relates generally to caskets, and more particularly to a casket cap brace support for holding the cap, which is pivoted to the body of the casket, in an upright, open position.

BACKGROUND OF THE INVENTION

A number of different mechanisms have been used to brace the cap of a casket in an upright, open position relative to the shell or body of the casket. Prior designs have generally included a relatively large number of parts and have been relatively complicated. Further, many of the prior designs have been fabricated from metal. Metal casket cap brace mechanisms are not desirable, however, for caskets which are to encounter the cremation process as the metal parts do not combust.

One prior combustible casket cap brace support includes a wooden C-shaped bracket affixed to an interior side wall of the body of the casket, and a wooden brace member pivoted on one end to the casket cap and including a protuberance on the other end. The brace member is received between the inner wall of the body of the casket and the web wall of the C-shaped bracket which interconnects the side walls of the bracket. When the cap is pivoted from the closed position to the open position, the brace member travels upwardly relative to the bracket until the protuberance on the lower end of the brace member contacts the bottom edge of the bracket. The length of the brace member and the location of the attachment points of the brace member to the cap and the bracket to the body are such that at the point the protuberance contacts the bottom edge of the bracket the cap center of gravity has gone over center of its hinge axis, i.e., the axis of pivoting between the cap and the body. Thus, the brace member is maintained in tension with the brace member protuberance in engagement with and restrained by the lower edge of the bracket and with the weight of the cap applying an axial tension force on the brace member on the other end. The cap is of course restrained from further pivoting by the brace member.

One problem associated with this crematable cap brace and bracket is that if the body of the casket or the casket cap is accidentally bumped, it is possible for the cap to inadvertently close which of course can be disruptive and is generally undesirable. Such is possible since only so much of a disturbance to the casket is required which would cause the cap weight to move back over center, at which time the brace member would be free to travel completely downwardly through the bracket in which case the cap would not be restrained and would simply fall until closing atop the casket body.

It is therefore an objective of the present invention to provide an improved combustible casket cap brace support which positively maintains the cap in the open position and which is resistant to inadvertent closing of the cap in the event that the casket cap or body is accidentally bumped.

SUMMARY OF THE INVENTION

In accordance with the stated objectives, in a casket having a shell or body and a cap pivoted to the body and closable thereupon a casket cap brace support is provided for supporting the pivotally mounted cap in an open position. The casket cap brace support comprises a support bracket adapted to be affixed to a wall of the casket body and including an aperture therethrough adapted to receive an end of a brace member, an elongated brace member having one end pivoted to the cap and the other end received in the support bracket aperture, the other end having a projection thereon, the support bracket having an elongated slot therein with a terminal end, the brace member projection being received in the slot during at least a portion of the movement of the cap to and between the closed and open positions, the slot being so configured such that when the cap is in the open position the brace member is in compression, the brace member projection residing in the slot terminal end and being prevented from moving out of the slot terminal end by the action of the weight of the cap, the cap thereby being resistant to inadvertent closing in the event that the casket cap or body is accidentally bumped.

Preferably the elongated slot has an initial end commencing at a lower end of the bracket, the brace member projection being received in the slot when moving the cover from the closed position to the open position, the brace member projection exiting the slot from the initial end when moving the cover member from the open position to the closed position.

Further preferably, the support bracket has two side walls and a web wall connected between the side wall, the side and web walls and the casket body wall defining the aperture, the elongated slot being an inverted J-shaped slot.

Still further preferably, one of the side walls of the support bracket nearest the pivot connection of the cap to the body is relieved on an upper end thereby providing clearance for the brace member when the cap is in the open position.

Yet further preferably, the support bracket includes a pin between the web wall and the casket body wall for guiding the brace member in the bracket and the projection into the initial end of the slot upon moving the cap from the closed position to the open position.

To better encounter the combustion process, the casket cap brace support is preferably fabricated of combustible materials, with the support bracket and brace member being fabricated preferably of wood and the fasteners which connect the support bracket and brace member to the body and cap respectively being fabricated preferably of plastic.

In another form of the present invention, the casket cap brace support comprises an elongated brace member having one end pivoted to the cap and having a projection on the other end, with the wall of the casket body having an elongated slot therein with a terminal end, the brace member projection being received in the slot during at least a portion of the movement of the cap to and between the closed and open positions. The elongated slot is preferably an inverted J-shaped slot with an initial end commencing at a lower position of the wall and a terminal end spaced from and above the initial end. The projection preferably has a shank, and a head having a larger cross sectional dimension than the shank, on the end of the shank. The slot preferably has a T cross section, with the head residing in the horizontal portion of the T, and the shank residing in the vertical portion of the T, the head thus being retained within the slot.

One advantage of the present invention is that an improved combustible casket cap brace support is provided which includes no metal components.

Another advantage of the present invention is that a casket cap brace support is provided which positively and securely holds the cap in the open position and does not leave the cap susceptible to inadvertent closing should the casket be accidentally bumped.

These and other objects and advantages of the present invention will become more readily apparent during the following detailed description taken in conjunction with the drawings herein, in which:

DETAILED DESCRIPTION OF THE INVENTION

Figure 1:
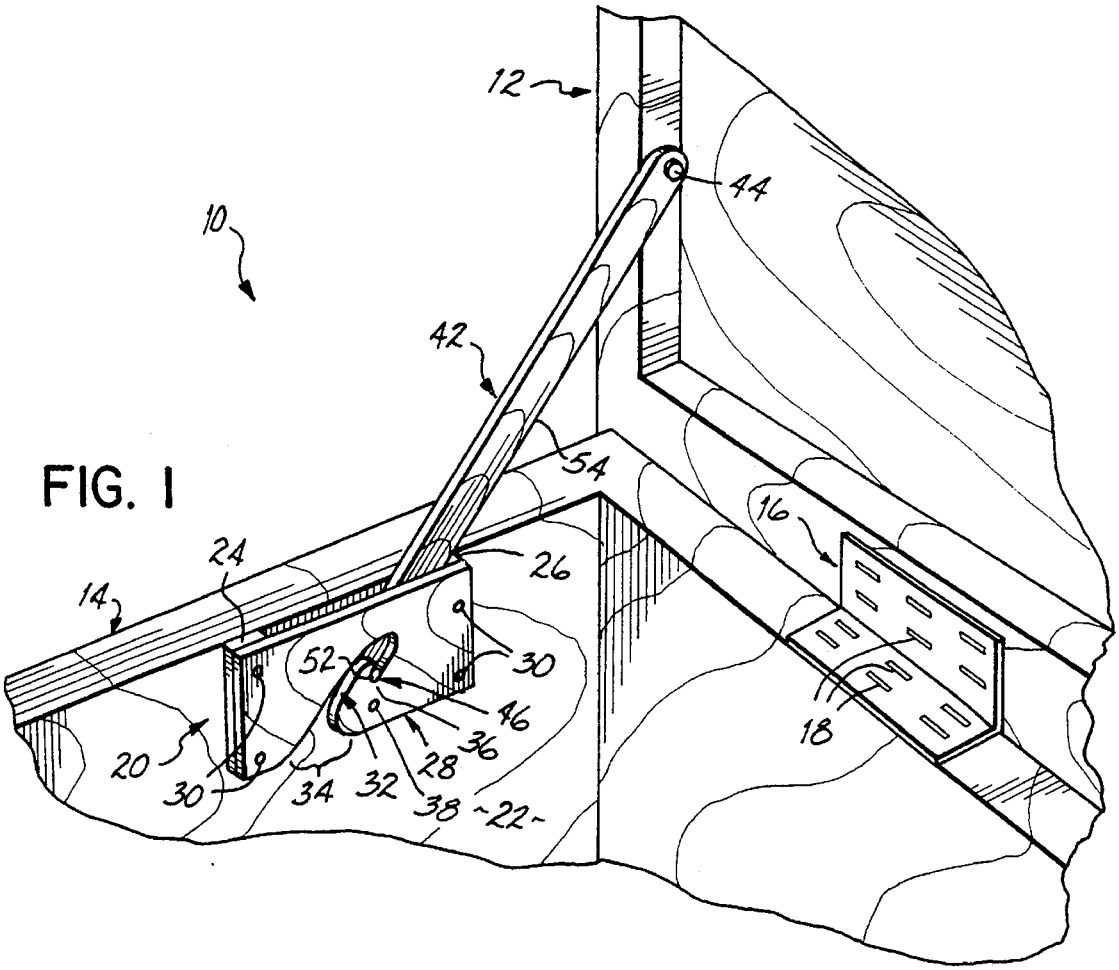
FIG. 1 is a perspective view of a casket employing the present invention.
Figure 2:
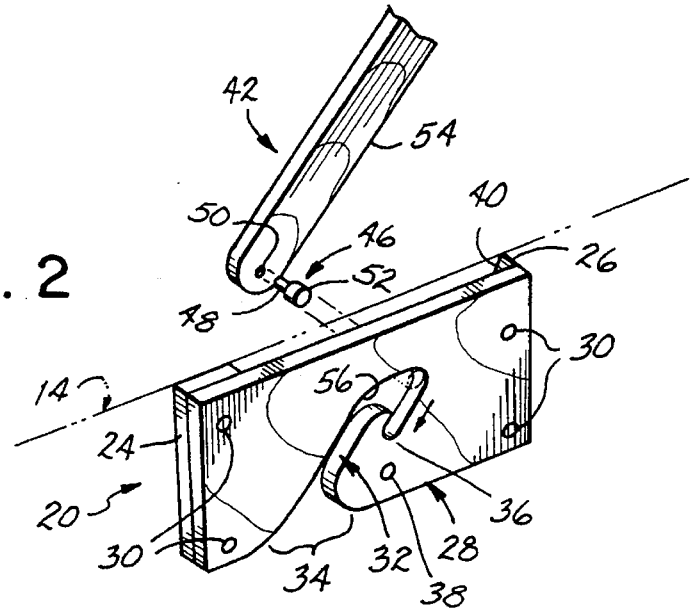
FIG. 2 is a view similar to FIG. 1 illustrating the bracket and a portion of the brace.

With reference first to FIG. 1, there is illustrated a casket 10 including a cap 12 pivoted to a shell or body 14 by way of a hinge 16. Hinge 16 is a living plastic hinge attached to the cap 12 and body 14 via staples 18, although other hinges of different construction and materials may of course be used.

A support bracket 20 is fixedly secured to the interior side of end wall 22 of the body 14 of the casket 10. Bracket 20 includes two side walls 24, 26 and a web wall 28 connected between the side walls 24 and 26. Side walls 24 and 26 are illustrated as standoffs separate and apart from the web wall 28, though it will be appreciated that side walls 24, 26 and web wall 28 could be formed of one integral piece of material. Bracket 20 is secured to wall 22 by the use of fasteners 30 which may take the form of wooden dowels or plastic so-called "Christmas Tree" type fasteners. Bracket 20 is preferably fabricated of wood.

Web wall 28 includes slot 32 having an initial end 34 and a terminal end 36. Slot 32 is generally in the form of an inverted J-shape. A pin 38 is pressed into side wall 28 and extends from side wall 28 to the wall 22 of the casket body 14, the purpose of which will be subsequently described. Side wall 26 is relieved at 40 for a purpose which will also be subsequently described.

An elongated brace member 42, preferably fabricated of wood, has one end pivotally connected to the cap 12 by a pin 44 which may be fabricated of wood or plastic. The other end of the elongated brace member 42 includes a projection or pin 46 having a shank 48 which is pressed into a hole 50 in the end of the brace member 42. Pin 46 further includes a head 52 thereon which cooperates with slot 32 in a manner which will be subsequently described.

Figure 3:
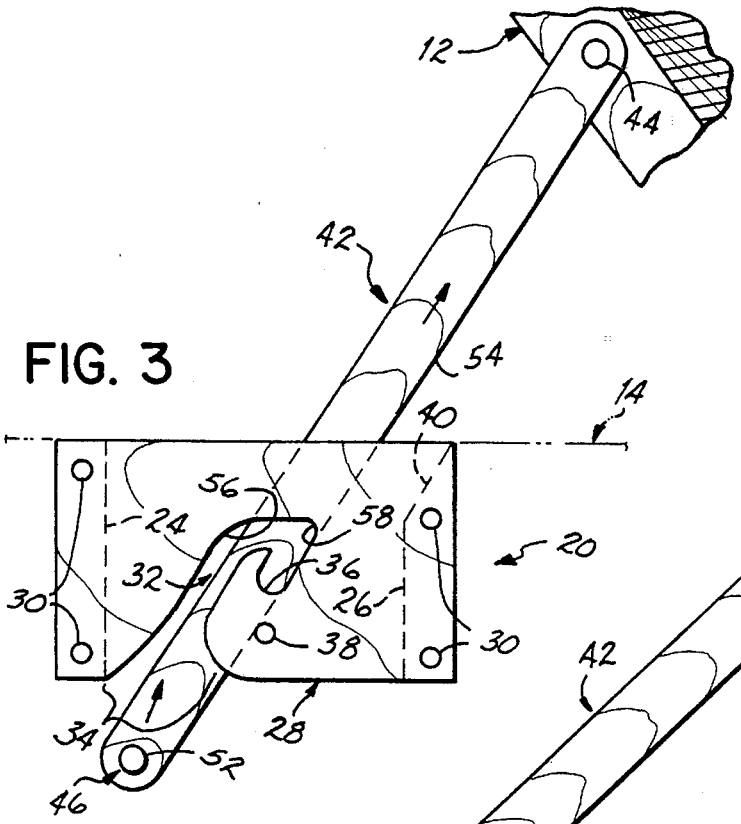
FIGS. 3–5 are time sequence illustrations of the movement of the cap and brace member with projection relative to the bracket.
Figure 4:
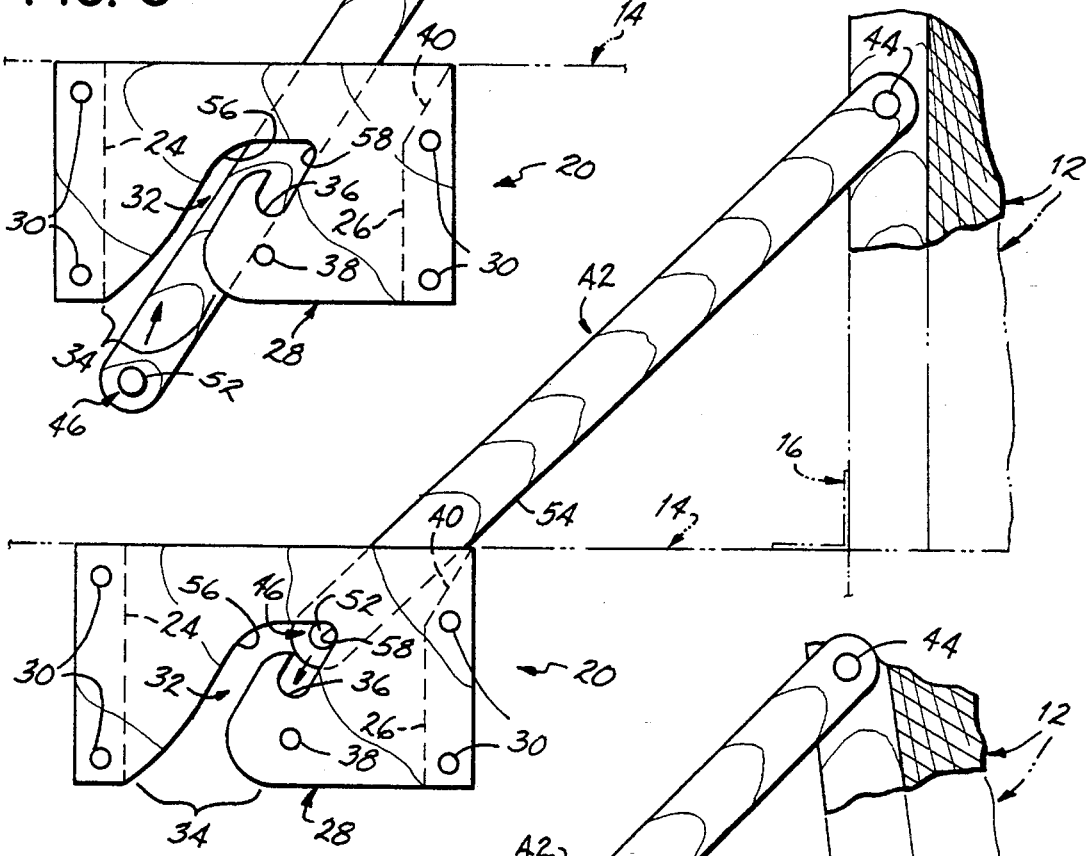
Figure 5:
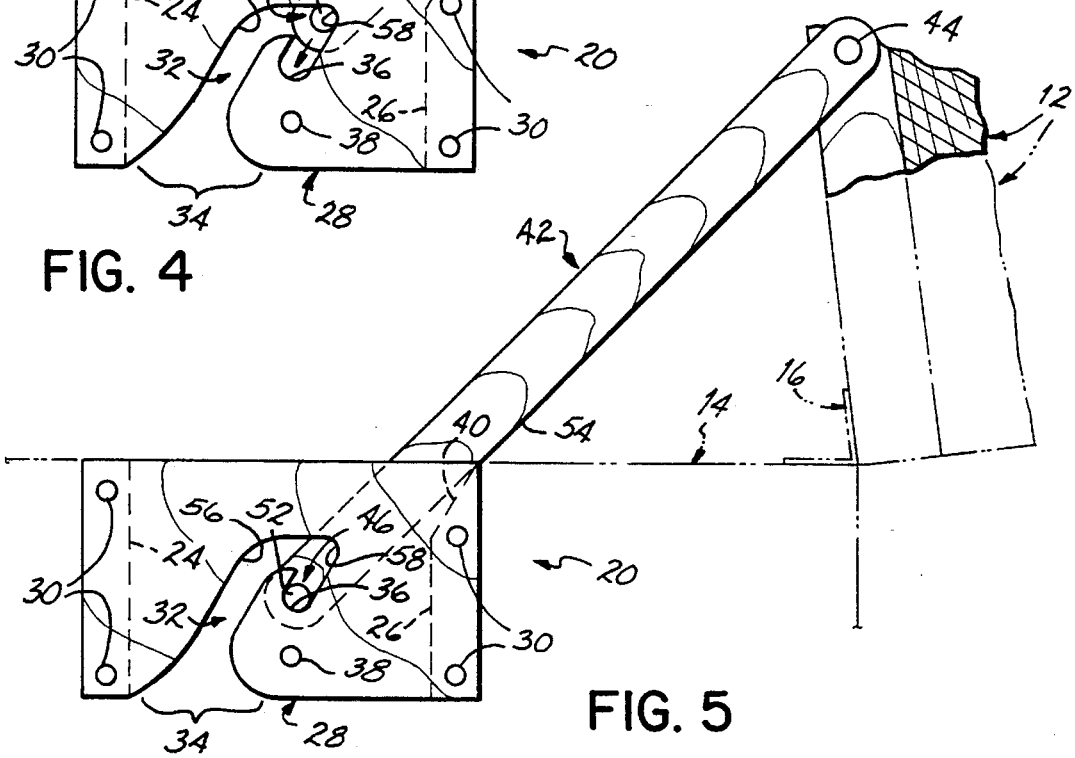

Referring now specifically to FIGS. 3–5, operation of the present invention during opening of the casket cap 12 will be described. As can be seen, pin 38 provides a guide for elongated brace member 42 within the bracket 20. Pin 38 is positioned below the terminal end 36 of the slot 32. In this position, the lower edge 54 of the brace member 42 rides upwardly on the pin 38 during opening of the cap 12, thus properly positioning head 52 of pin 46 relative to the slot 32. Continued upward movement of the cap 12 causes the head 52 of pin 46 to enter into the slot 32 at its initial end 34. Continued upward movement of the cap 22 causes the head 52 of pin 46 to follow the slot 32 including the curved portion 56. Cap 12 is pivoted to the point at which pin head 52 contacts corner 58 of slot 32, at which time further pivoting of cap 12 is not possible. At that point, the cap 12 is allowed to move slightly toward the closed position via gravity at which time pin head 52 drops into the terminal end 36 of the slot 32. Slot 32 thus forms a track for head 52 of pin 46 during movement of cap 12. At this point the casket cap is maintained positively in an upright, open position, and inadvertent or accidental bumping of the casket will not cause the casket cap to crash closed since the action of the weight of the cap on pin head 52 of pin 46 and terminal end 36 of slot 32 maintains cap 12 in the open position, the brace member 42 being in compression.

To move the cap 12 back to the closed position, one need merely pivot the cap 12 slightly to the open position thus bringing the head 58 of pin 46 to the position shown in FIG. 4. At that point, hand pressure on the lower edge 54 of brace member 42 moves the head 52 of pin 46 toward the curved portion 56 of slot 32, at which time continued controlled downward movement of cap 12 allows the head 52 of pin 46 to drop out of the initial end 34 of the slot 32, the brace member 42 being guided all the while on pin 38. Cap 12 is then simply lowered down to its closed position.

Figure 6:
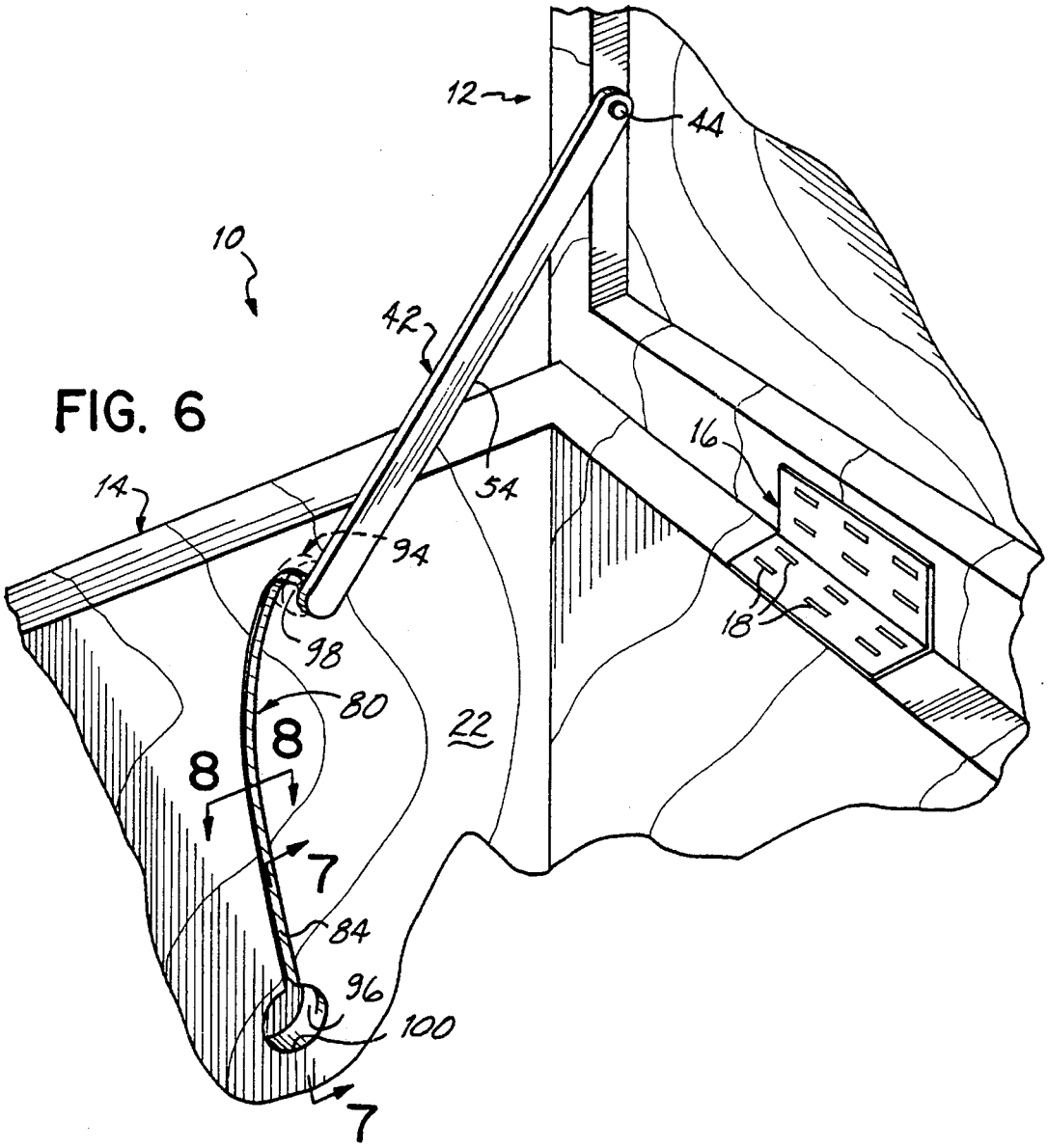
FIG. 6 is a perspective view of the casket employing an alternative form of the present invention.
Figure 7:
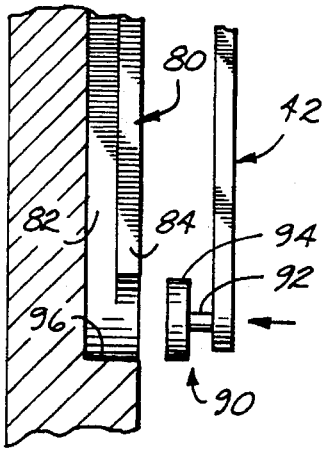
FIG. 7 is a view taken along line 7—7 of FIG. 6.
Figure 8:
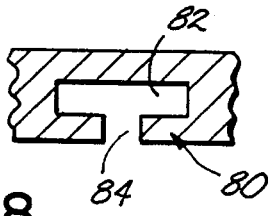
FIG. 8 is a view taken along line 8—8 of FIG. 7.

In FIGS. 6–8, an alternative form of the present invention is illustrated. With like numbers representing like elements, a slot 80 is routed directly into end wall 22 of the wooden casket body 14. Slot 80 is in the form of an inverted J shape, and in cross section, is in the form of a generally T shape including a horizontal portion 82 and a vertical portion 84 as shown in FIG. 8. Projection 90 of brace member 42 includes a shank 92 and a head 94 of a larger cross sectional dimension than the shank 92. The slot 80 includes an initial end 96 and a terminal end 98 spaced from and above the initial end 96. The initial end 96 includes a keyhole 100 which accepts head 94 of projection 90.

During installation, head 94 is inserted into keyhole 100 and brace member 42 is moved upwardly within slot 80, head 94 being retained in horizontal portion 82 and shank 92 residing in vertical portion 84. Pin 44 is then installed to secure brace member 42 to cap 12. Brace member 42 is of such a length that when cap 12 is lowered down to its closed position atop body 14, head 94 does not completely reach down to keyhole 100, thus being retained within horizontal portion 82 of the slot 80. As in the prior embodiment, slot 80 forms a track for head 94 of projection 90.

Operation of this form of the present invention works in much the same manner as the prior embodiment. When moving the cap 12 to the open position, head 94 of projection 90 translates along horizontal portion 82 of the slot 80, while the shank 92 translates through the vertical portion 84 of the slot 80. Cap 12 is pivoted to the point at which shank 92 is within terminal portion 98 of slot 80, at which time the brace member 42 is in compression due to the weight of the cap 12. In a manner similar to that of the prior embodiment, to move the cap back to the closed position, one need merely pivot the cap 12 slightly to the open position while applying hand pressure on the lower edge 54 of brace member 42 such that the shank 92 of projection 90 moves out of the terminal end 98 of the slot 80 and begins a downward descent along slot 80. Cap 12 is then simply lowered down to its closed position.

Those skilled in the art will readily recognize numerous adaptations and modifications which can be made to the present invention which will result in an improved casket cap brace support, all of which will fall within the spirit and scope of the present invention as defined in the following claims. Accordingly, the invention is to be limited only by the scope of the following claims and their equivalents.

What is claimed is:

1. A combustible casket adapted to support a deceased person therein comprising a body, a cap pivoted to said body and closeable thereupon, and a casket cap brace support for supporting said pivotally mounted cap in an open position, said brace support comprising:

a support bracket fabricated from a combustible material adapted to be affixed to a wall of said casket body and including an aperture therethrough adapted to receive an end of a brace member;

an elongated brace member fabricated from a combustible material having one end pivoted to said cap and the other end received in said support bracket aperture, said other end having a projection thereon;

said support bracket having an elongated slot therein with a terminal end, said brace member projection being received in said slot during at least a portion of the movement of said cap to and between the closed and open positions;

said slot being so configured such that when said cap is in the open position said brace member is in compression, said brace member projection residing in said slot terminal end and being prevented from moving out of said slot terminal end by the action of the weight of said cap, said cap thereby being resistant to inadvertent closing in the event that said casket cap or body is accidently bumped.

2. The casket of claim 1 wherein said support bracket and brace member are connected to said body and cap respectively with fasteners fabricated of combustible material.

3. A combustible casket adapted to support a deceased person therein comprising a body, a cap pivoted to said body and closeable thereupon, and a casket cap brace support for supporting said pivotally mounted cap in an open position, said brace support comprising:

a support bracket fabricated from a combustible material adapted to be affixed to a wall of said casket body and including an aperture therethrough adapted to receive an end of a brace member;

an elongated brace member fabricated from a combustible material having one end pivoted to said cap and the other end received in said support bracket aperture, said other end having a projection thereon;

said support bracket having an elongated slot therein with an initial end commencing at a lower edge of said bracket and a terminal end spaced from said initial end, said brace member projection being received in said slot when moving said cap from the closed position to the open position, said brace member projection exiting said slot from said initial end when moving said cap from the open position to the closed position;

said slot being so configured such that when said cap is in the open position said brace member is in compression, said brace member projection residing in said slot terminal end and being prevented from moving out of said terminal end and from exiting said slot by the action of the weight of said cap, said cap thereby being resistant to inadvertent closing in the event that said casket cap or body is accidently bumped.

4. The casket of claim 3 wherein said support bracket and brace member are connected to said body and cap respectively with fasteners fabricated of combustible material.

5. The casket of claim 3 wherein said support bracket includes a guide for guiding said brace member in said bracket and said projection into said initial end of said slot upon moving said cap from the closed position to the open position.

6. A combustible casket adapted to support a deceased person therein comprising a body, a cap pivoted to said body and closeable thereupon, and a casket cap brace support for supporting said pivotally mounted cap in an open position, said brace support comprising:

a support bracket fabricated from a combustible material adapted to be affixed to a wall of said casket body and having two side walls and a web wall connected between said side walls, said side and web walls and said casket body wall defining an aperture through which is received an end of a brace member;

an elongated brace member fabricated from a combustible material having one end pivoted to said cap and the other end received in said support bracket aperture, said other end having a projection thereon;

said support bracket having an elongated, inverted J-shaped slot therein with an initial end commencing at a lower edge of said bracket web wall and a terminal end spaced from said initial end, said brace member projection being received in said slot when moving said cap from the closed position to the open position, said brace member projection exiting said slot from said initial end when moving said cap from the open position to the closed position;

said slot being so configured such that when said cap is in the open position said brace member is in compression, said brace member projection residing in said slot terminal end and being prevented from moving out of said terminal end and from exiting said slot by the action of the weight of said cap, said cap thereby being resistant to inadvertent closing in the event that said casket cap or body is accidently bumped.

7. The casket of claim 6 wherein said combustible material is wood.

8. The casket of claim 6 wherein said support bracket and brace member are connected to said body and cap respectively with fasteners fabricated of combustible material.

9. The casket of claim 8 wherein said combustible material is plastic.

10. The casket of claim 6 wherein one of said side walls of said support bracket nearest the pivot connection of said cap to said body is relieved on an upper end thereof thereby providing clearance for said brace member when said cap is in the open position.

11. The casket of claim 6 wherein said support bracket includes a pin between said web wall and said casket body wall for guiding said brace member in said bracket and said projection into said initial end of said slot upon moving said cap from the closed position to the open position.

12. In a casket having a body with a wall and a cap pivoted to the body and closeable thereupon, a casket cap brace support for supporting the pivotally mounted cap in an open position comprising:

an elongated brace member having one end pivoted to the cap and having a projection on the other end;

said wall having an elongated slot formed therein with a terminal end, said brace member projection being received in said slot during at least a portion of the movement of the cap to and between the closed and open positions;

said slot being so configured such that when the cap is in the open position said brace member is in compression, said brace member projection residing in said slot terminal end and being prevented from moving out of said slot terminal end by the action of the weight of the cap, the cap thereby being resistant to inadvertent closing in the event that the casket cap or body is accidently bumped.

13. In a casket having a body with a wall and a cap pivoted to the body and closeable thereupon, a casket cap brace support for supporting the pivotally mounted cap in an open position comprising:

an elongated brace member having one end pivoted to the cap and having a projection on the other end;

said wall having an elongated, inverted J-shaped slot formed therein with an initial end commencing at a lower position of said wall and a terminal end spaced from and above said initial end, said brace member projection being received in said slot when moving the cap from the closed position to the open position and back;

said slot being so configured such that when the cap is in the open position said brace member is in compression, said brace member projection residing in said slot terminal end and being prevented from moving out of said terminal end by the action of the weight of the cap, the cap thereby being resistant to inadvertent closing in the event that the casket cap or body is accidently bumped.

14. The casket cap brace support of claim 13 wherein said brace member is fabricated of combustible material, and wherein said brace member is connected to the cap with fasteners fabricated of combustible material.

15. In a casket having a body with a wall and a cap pivoted to the body and closeable thereupon, a casket cap brace support for supporting the pivotally mounted cap in an open position comprising:

an elongated brace member having one end pivoted to the cap and having a projection on the other end;

said wall having an elongated, inverted J-shaped slot therein with an initial end commencing at a lower position of said wall and a terminal end spaced from and above said initial end, said brace member projection being received in said slot when moving the cap from the closed position to the open position and back;

said slot being so configured such that when the cap is in the open position said brace member is in compression, said brace member projection residing in said slot terminal end and being prevented from moving out of said terminal end by the action of the weight of the cap, the cap thereby being resistant to inadvertent closing in the event that the casket cap or body is accidently bumped, wherein:

said projection has a shank, and a head, having a longer cross-sectional dimension than said shank, on an end of said shank;

said slot having a T cross-section, said head residing in the horizontal portion of said T, said shank residing in the vertical portion of said T, said head being thus retained within said slot.

16. A combustible casket adapted to support a deceased person therein comprising a body with a wall, a cap pivoted to said body and closeable thereupon, and a casket cap brace support for supporting said pivotally mounted cap in an open position, said brace support comprising:

an elongated brace member fabricated from a combustible material having one end pivoted to said cap and having a projection on the other end;

said wall having an elongated slot adjacent thereto with a terminal end, said brace member projection being received in said slot during at least a portion of the movement of said cap to and between the closed and open positions;

said slot being so configured such that when said cap is in the open position said brace member is in compression, said brace member projection residing in said slot terminal end and being prevented from moving out of said slot terminal end by the action of the weight of said cap, said cap thereby being resistant to inadvertent closing in the event that said casket cap or body is accidently bumped.

17. A combustible casket adapted to support a deceased person therein comprising a body with a wall, a cap pivoted to said body and closeable thereupon, and a casket cap brace support for supporting said pivotally mounted cap in an open position, said brace support comprising:

an elongated brace member fabricated from a combustible material having one end pivoted to said cap and having a projection on the other end;

said wall having an elongated, inverted J-shaped slot adjacent thereto with an initial end commencing at a lower position of said wall and a terminal end spaced from and above said initial end, said brace member projection being received in said slot when moving said cap from the closed position to the open position and back;

said slot being so configured such that when said cap is in the open position said brace member is in compression, said brace member projection residing in said slot terminal end and being prevented from moving out of said terminal end by the action of the weight of said cap, said cap thereby being resistant to inadvertent closing in the event that said casket cap or body is accidently bumped.

* * * * *